US005777186A

United States Patent [19]

Shimizu

[11] Patent Number: 5,777,186

[45] Date of Patent: Jul. 7, 1998

[54] PROCESS FOR HYDROGENATING BENZENE IN HYDROCARBON OILS

[75] Inventor: Toshio Shimizu, Satte, Japan

[73] Assignees: Cosmo Research Institute; Cosmo Oil Co., Ltd., both of Tokyo, Japan

[21] Appl. No.: 944,789

[22] Filed: Oct. 6, 1997

Related U.S. Application Data

[63] Continuation of Ser. No. 514,385, Aug. 11, 1995, abandoned.

[30] Foreign Application Priority Data

Aug. 29, 1994 [JP] Japan ..... 7-203353

[51] Int. Cl.[6] ..... C07C 5/10

[52] U.S. Cl. ..... 585/269; 585/270; 585/271; 585/273; 585/274

[58] Field of Search ..... 585/266, 267, 585/269, 2.71, 2.73, 270, 274

[56] References Cited

U.S. PATENT DOCUMENTS 3,943,067 3/1976 Chan et al. ..... 252/430

4,678,861 7/1987 Mitsui et al. ..... 585/266

OTHER PUBLICATIONS

Dobert & Baube, "Kinetics and Reaction Engineering of Selective Hydrogenation of Benzene towards Cyclohexene", Chemical Engineering Science, vol. 51, No. 11, pp. 2873–2877, 1996, Jun.

*Primary Examiner*—Bekir L. Yildirim

*Attorney, Agent, or Firm*—Oblon, Spivak, McClelland, Maier & Neustadt, P.C.

[57] ABSTRACT

A process for selectively hydrogenating benzene in a hydrocarbon oil is disclosed. The process comprises reacting the hydrocarbon oil with hydrogen gas in the presence of a hydrogenation catalyst comprising at least one metal in Group VIII of the Periodic Table and an alkaline aqueous layer which contains zinc or a zinc compound. Benzene in hydrocarbon oils can be selectively converted into cyclohexane by the process, while suppressing the hydrogenation reaction of alkyl aromatic compounds which are important high octane materials for gasoline.

22 Claims, No Drawings

PROCESS FOR HYDROGENATING BENZENE IN HYDROCARBON OILS

This application is a continuation of application Ser. No. 08/514,385, filed on Aug. 11, 1995, now abandoned.

BACKGROUND OF THE INVENTION

1. Field of the Invention

The present invention relates to a process for selectively hydrogenating benzene contained in hydrocarbon oil to convert the benzene to cyclohexane, cyclohexene, or the like, thereby reducing the amount of benzene, and in particular, to a process for selectively hydrogenating benzene in gasoline to reduce the benzene content.

2. Description of the Background Art

Aromatic compounds in fuels are easily converted into soot and dust by burning and exhausted into the air. In addition, unburned aromatic compounds are noxious to humans and cause environmental problems. Because of these reasons, reducing aromatic compounds in fuels is strongly desired. In particular, regulation of the benzene content of gasoline is planned in the United States in the near future.

As a process for selectively separating out the benzene, only an extraction process using solvents such as sulforane and the like is currently known in the petroleum industry. In spite of the advantages of high yield and selectivity of almost 100%, this process requires a large plant and a complicated extraction procedure, which results in a high manufacturing cost for gasoline. In addition, there are problems concerning the utilization of recovered benzene. Thus, the process is not satisfactory as a countermeasure for reducing the benzene content of gasoline.

A recent report proposes a method for converting benzene in gasoline into other compounds by a chemical reaction and separating out these compounds. For example, JP-B-5-508172 discloses a process for reducing benzene in gasoline by selectively alkylating benzene in gasoline into alkylbenzenes with olefins in the presence of a solid acid catalyst (The term "JP-B" as used herein means an "examined Japanese patent publication"). This process has advantages in that the process itself is very simple and the alkylbenzenes produced can be blended into gasoline as a high octane blending stock. Notwithstanding these advantages, it has the drawback of producing heavy alkylbenzenes which are unsuitable as a gasoline blending stock and the drawback of involving side reactions of olefins. Another problem is unavailability of low cost olefins. Thus, it is difficult to use this process commercially.

U.S. Pat. No. 4,645,585 discloses a process for reducing benzene in gasoline by converting the benzene primarily to cyclohexylbenzene by a hydroalkylation reaction using a solid acid catalyst carrying a noble metal and separating out the cyclohexylbenzene and the like by distillation. Although this process has an advantage in that the cyclohexylbenzene produced can be used as a blending stock for gas oil or kerosene if further hydrogenated, it has a problem in the low yield of cyclohexylbenzene due to a complete hydrogenation reaction of benzene which is predominant over the production of cyclohexylbenzene. In addition, cyclohexane, which is the product of the complete hydrogenation reaction of benzene, cannot be removed by distillation. It is therefore difficult to commercially apply this process as a method for reacting and separating out the benzene.

U.S. Pat. No. 5,284,984 discloses a process for converting benzene in gasoline to aromatic nitro compounds by directly nitrifying the benzene, hydrogenating the aromatic nitro compounds without separating them from gasoline, and then transferring aromatic amine compounds thus produced to a gasoline pool. This process is attracting attention as a new technology for treating benzene due to the possibility of using aromatic amines as an octane booster. However, the use of nitric acid in the nitrification step involves a large investment for a large scale plant. An additional problem is that the reaction accompanies nitrification of aromatic hydrocarbons other than benzene. Moreover, the uncertainty of justifying blending aromatic amines into gasoline due to the possibility of causing environmental problems makes it very difficult to apply this technology to a commercial plant.

U.S. Pat. No. 5,294,334 discloses a process for reducing the benzene content by separating benzene from gasoline by adsorption using a zeolite layer, hydrogenating the separated benzene to cyclohexane in the next step, and returning the cyclohexane to a gasoline pool. This method utilizes the capability of zeolite to adsorb benzene. Desorption of benzene is carried out using cyclohexane produced by the hydrogenation of benzene. Because cyclohexane produced by the hydrogenation of benzene can be used as a blending stock for gasoline, this method attracts an attention as a technology for reducing benzene without decreasing the total amount of blending stock for gasoline. However, because the adsorption-desorption operation in the zeolite adsorbent layer cannot be continuously carried out, the process requires a large zeolite adsorbent layer, resulting in an unacceptably high investment cost.

There are various other processes proposed for reducing the benzene content of gasoline. However, all these processes require numerous improvements to be commercially applied.

The reaction for completely hydrogenating aromatic hydrocarbons such as benzene to naphthenes such as cyclohexane is commercially applied using, for example, Ni-type catalysts. This reaction itself is an industrially established technology. However, it is impossible to apply this technology to the selective hydrogenation only of specific hydrocarbons in the feedstocks, such as gasoline, which contain various aromatic hydrocarbons. Besides benzene, the reaction hydrogenates alkylbenzenes which are important octane boosters, although this depends upon the reaction conditions. Thus, even if the benzene content can be reduced, a great decrease in the octane value of the resulting hydrogenated products is unavoidable. This reaction, therefore, cannot be applied to the reduction of benzene in hydrocarbon oil such as gasoline.

The object of the present invention is therefore to provide a process for selectively hydrogenating benzene in hydrocarbon oil which contain various aromatic compounds, such as gasoline, to reduce the benzene content without reducing certain characteristics of the hydrocarbon oil such as octane number.

As a result of extensive studies, the inventor of the present invention has found that if a hydrogenation reaction of hydrocarbon oil containing aromatic compounds is carried out in the presence of water, a specific hydrogenation catalyst, and a zinc compound, only benzene can be selectively hydrogenated without affecting other aromatic compounds, thereby producing hydrocarbon oil with a low benzene content. In the case of gasoline, the hydrocarbon oil can be used as a low benzene content gasoline stock as are. This finding has led to the completion of the present invention.

SUMMARY OF THE INVENTION

Accordingly, an object of the present invention is to provide a process for hydrogenating benzene in a hydrocarbon oil which comprises reacting the hydrocarbon oil with hydrogen gas in the presence of a hydrogenation catalyst comprising at least one metal in Group VIII of the Periodic Table and an alkaline aqueous layer which contains zinc or a zinc compound. Either one or two or more metals in Group VIII of the Periodic Table can be used for the hydrogenation catalyst.

Other and further objects, features and advantages of the present invention will appear more fully from the following description.

DETAILED DESCRIPTION OF THE INVENTION AND PREFERRED EMBODIMENTS

Any hydrogenation catalyst comprising an active metal belonging to Group VIII of the Periodic Table can be used in the present invention. Preferred metals are a noble metal and Ni, and particularly, Ru, Rh, Pd, Pt, and Ni. Of these, Au is an ideal active metal component.

These metals may be present in the hydrogenation catalyst either as the metal itself or in the form of an oxide. The active metal or metal oxide may be used either on a carrier or as particles. As the carrier, common carriers, such as alumina, silica, silica alumina, iron oxide, magnesia, zirconia, carbon, and the like, can be used. Preferred catalysts are ruthenium metal particles or fine particles of ruthenium oxide. Compounds which are converted into a Group VIII metal in the reaction system, such as ruthenium chloride, can be also used as the catalyst.

The amount of hydrogenation catalyst may be optionally selected from the range in which the hydrogenation reaction proceeds. In view of economy, such an amount, in terms of molar ratio of benzene and the Group VIII metal in the hydrogenation catalyst, is preferably 100–1000.

Given as zinc or zinc compounds used in the present invention are zinc powders and zinc particles, and zinc compounds such as zinc acetate, zinc benzoate, zinc bromide, zinc carbonate, zinc chloride, zinc iodide, zinc lactate, zinc nitrate, zinc oxide, zinc pyrophosphate, zinc phosphate, zinc salicylate, zinc sulfate, and the like. Of these, zinc oxide and zinc sulfate are particularly preferred. The amount of zinc or zinc compounds is such that the molar ratio of the Group VIII metal in the hydrogenation catalyst and the zinc or zinc compounds be in the range of 1:100–100:1, and preferably 1:10–10:1. This ratio of the Group VIII metal in the hydrogenation catalyst and the zinc or zinc compounds is important to improve the selectivity of hydrogenation reaction of benzene. If no zinc or zinc compounds are present, no selectivity of the reaction for hydrogenating benzene is achieved, giving rise to hydrogenation of alkylbenzenes, such as toluene, o-xylene, m-xylene, p-xylene and ethylbenzene.

In order to improve the selectivity, it is imperative for the process of the present invention that both the hydrogenation catalyst and zinc or zinc compounds are present in the water phase and further that the water phase is maintained under alkaline conditions. The term "alkaline conditions" herein means conditions of pH 7 or higher, and preferably pH 9 or higher.

The selectivity of benzene hydrogenation in gasoline fractions is remarkably increased when the water phase is kept alkaline. Strong alkaline agents, such as lithium, hydroxide, sodium hydroxide, and potassium hydroxide, are preferably used for adjusting the alkalinity of the water phase. Carbonates or bicarbonates of an alkali metal compound such as sodium, potassium, or lithium, can also be used. The concentration of the alkaline agent is preferably 0.01–5M, and particularly preferably 0.1–1M. Anionic exchange resins, preferably strong basic anionic exchange resins, may be used instead of the alkaline agents. Although the reason why only benzene is hydrogenated with almost no alkylbenzenes being hydrogenated when the water phase is kept alkaline has not been elucidated, it is thought such that the surface of the hydrogenation catalyst which is present in the water phase is modified by hydroxy ion to some form, which produces activity points capable of selectively hydrogenating benzene on that catalyst surface.

The hydrogenation process of the present invention can be applicable to all hydrocarbon oils containing benzene, with no restriction on the concentration of benzene. The process is particularly suitable for reducing the benzene content in gasoline fractions containing benzene, especially in reformates which contain benzene at a high concentration. Although reformates contains alkylbenzenes with a boiling point higher than benzene, such as toluene, o-xylene, m-xylene, p-xylene, trimethylbenzenes, and the like, there is no need to increase the concentration of benzene by distillation or the like to use the reformates as the feed to the process of the present invention. An optimum scheme can be determined taking economy, such as investment costs and the like, into consideration. In addition to aromatic hydrocarbons such as benzene, gasoline fractions such as reformates containing paraffins, olefins, and naphthenes can be used. These other hydrocarbons have no specific influence on the reaction, except that olefins are hydrogenated under the conditions of the hydrogenation reaction of the process of the present invention.

The hydrogenation reaction of the present invention is normally carried out in a batch reactor. Two separate layers, one, an organic layer of raw material hydrocarbon oil, and the other, an aqueous layer comprising the hydrogenation catalyst and zinc or a zinc compound, are present in the reactor. The hydrogenation catalyst is present as a solid and the zinc or the zinc compound is present dissolved in water or as a solid. Any optional ratio of the organic layer and the aqueous layer is applicable, with a preferable ratio being 0.1–10 (vol/vol).

The reaction is carried out under hydrogen pressure. Any arbitrary partial pressure of hydrogen under which the hydrogenation reaction proceeds may be used. The preferable partial pressure is in the range of 5–100 $kg/cm^2$.G in view of economy and ease of the reaction. It is possible to carry out the hydrogenation reaction while passing hydrogen gas through a pressurized reaction system. In this instance, any optional flow rate is applicable. The reaction temperature is 50°–300° C., and preferably 100°–200° C.

The rate and efficiency of stirring are important for the reaction. The stirring efficiency depends upon the shapes of the reactor and the stirrer blades and upon the rate of rotation. A rotation rate in the range of 50–1000 rpm is usually preferable.

Separation of the reaction products from the aqueous layer can be easily done by means of the two-phase reaction system. In addition, the aqueous layer which contains the catalyst after separation can be used for the succeeding reactions without any special treatment.

The process of the present invention can convert benzene into cyclohexane by selective hydrogenation of benzene, while suppressing the hydrogenation reaction of alkyl aromatic compounds which are important as high octane materials for gasoline. Thus, the process can reduce the benzene content of hydrocarbon oils such as gasoline with industrial advantages without complicated procedures in conventional processes such as distillation or extraction of benzene.

Other features of the invention will become apparent in the course of the following description of the exemplary embodiments which are given for illustration of the invention and are not intended to be limiting thereof.

EXAMPLES

Example 1

To a stainless steel autoclave with an internal volume of 300 ml, 50 ml of distilled water, 0.26 g of ruthenium oxide (manufactured by Aldlich Co.), 0.5 g of $ZnSO_4.7H_2O$ (special grade, manufactured by Kanto Chemical Co., Ltd.), and 0.5 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 37.5 wt %; cyclohexane, 5.6 wt %; cyclohexene, 6.0 wt %; toluene, 50.1 wt %; methylcyclohexane, 0.3 wt %; and methylcyclohexenes, 0.4 wt %. The conversion rate of benzene was 23.6%, while that of toluene was 1.4%, with the ratio of the benzene conversion rate/toluene conversion rate being 16.9.

Example 2

The hydrogenation reaction was carried out under the same conditions as in Example 1, except that 25 ml of p-xylene (a special grade product of Wako Pure Chemical Industries, Ltd.) was used instead of toluene. The liquid yield was 100%, with the product distribution being benzene, 39.3 wt %; cyclohexane, 6.9 wt %; cyclohexene, 6.3 wt %; p-xylene, 47.5 wt %; dimethylcyclohexanes, 0.0 wt %; and dimethylcyclohexenes, 0.0 wt %. The conversion rate of benzene was 25.2%, while that of p-xylene was 0.0%.

Example 3

The hydrogenation reaction was carried out under the same conditions as in Example 1, except that 25 ml of mesitylene (a special grade product of Wako Pure Chemical Industries, Ltd.) was used instead of toluene. The liquid yield was 100%, with the product distribution being benzene, 31.3 wt %; cyclohexane, 10.6 wt %; cyclohexene, 8.1 wt %; mesitylene, 50.0 wt %; trimethylcyclohexanes, 0.0 wt %; and trimethylcyclohexenes, 0.0 wt %. The conversion rate of benzene was 37.4%, while that of mesitylene was 0.0%.

Example 4

To a stainless steel autoclave with an internal volume of 300 ml, 50 ml of distilled water, 0.2 g of ruthenium black (manufactured by Aldlich Co.), 0.5 g of $ZnSO_4.7H_2O$ (special grade, manufactured by Kanto Chemical Co., Ltd.), and 0.5 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 47.4 wt %; cyclohexane, 1.4 wt %; cyclohexene, 1.7 wt %; toluene, 49.2 wt %; methylcyclohexane, 0.2 wt %; and methylcyclohexenes, 0.1 wt %. The conversion rate of benzene was 6.1%, while that of toluene was 0.6%, with the ratio of the benzene conversion rate/toluene conversion rate being 10.2.

Example 5

The hydrogenation reaction was carried out under the same conditions as in Example 4, except that 0.2 g of Raney nickel (a special grade product of Wako Pure Chemical Industries, Ltd.) was used instead of ruthenium black. The liquid yield was 100%, with the product distribution being benzene, 47.2 wt %; cyclohexane, 1.5 wt %; cyclohexene, 1.9 wt %; toluene, 49.4%; methylcyclohexane, 0.0 wt %; and methylcyclohexenes, 0.0 wt %. The conversion rate of benzene was 6.7%, while that of toluene was 0.0%.

Example 6

The hydrogenation reaction was carried out under the same conditions as in Example 4, except that 4 g of 5%-Ru on carbon (manufactured by Aldlich Co.) was used instead of ruthenium black. The liquid yield was 100%, with the product distribution being benzene, 16.1 wt %; cyclohexane, 35.5 wt %; cyclohexene, 0.0 wt %; toluene, 43.6 wt %; methylcyclohexane, 3.8 wt %; and methylcyclohexenes, 1.0 wt %. The conversion rate of benzene was 68.8%, while that of toluene was 9.9%, with the ratio of the benzene conversion rate/toluene conversion rate being 6.9.

Example 7

The hydrogenation reaction was carried out under the same conditions as in Example 4, except that 4 g of 5%-Pd on $Al_2O_3$ (manufactured by Aldlich Co.) was used instead of ruthenium black. The liquid yield was 100%, with the product distribution being benzene, 48.5 wt %; cyclohexane, 0.2 wt %; cyclohexene, 0.8 wt %; toluene, 50.4 wt %; methylcyclohexane, 0.0 wt %; and methylcyclohexenes, 0.1 wt %. The conversion rate of benzene was 2.0%, while that of toluene was 0.2%, with the ratio of the benzene conversion rate/toluene conversion rate being 10.

Example 8

The hydrogenation reaction was carried out under the same conditions as in Example 4, except that 0.2 g of Palladium black (manufactured by Aldlich Co.) was used instead of ruthenium black. The liquid yield was 100%, with the product distribution being benzene, 49.0 wt %; cyclohexane, 0.2 wt %; cyclohexene, 0.8 wt %; toluene, 50.0 wt %; methylcyclohexane, 0.0 wt %; and methylcyclohexenes, 0.0 wt %. The conversion rate of benzene was 2.0%, while that of toluene was 0.0%.

Example 9

To a stainless steel autoclave with an internal volume of 300 ml, 50 ml of distilled water, 1.0 g of ruthenium oxide (manufactured by Aldlich Co.), 0.5 g of $ZnSO_4.7H_2O$ (special grade, manufactured by Kanto Chemical Co., Ltd.), and 0.5 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 16.4 wt %; cyclohexane, 24.0 wt %; cyclohexene, 9.1 wt %; toluene, 47.6 wt %; methylcyclohexane, 1.5 wt %; and methylcyclohexenes, 1.3 wt %. The conversion rate of benzene was 66.9%, while that of toluene was 5.6%, with the ratio of the benzene conversion rate/toluene conversion rate being 12.2.

Example 10

To a stainless steel autoclave with an internal volume of 300 ml, 50 ml of distilled water, 1.0 g of ruthenium oxide (manufactured by Aldlich Co.), 1.92 g of $ZnSO_4.7H_2O$ (special grade, manufactured by Kanto Denka Kogyo Co., Ltd.), and 1.92 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 34.2 wt %; cyclohexane, 6.9 wt %; cyclohexene, 9.2 wt %; toluene, 49.1 wt %; methylcyclohexane, 0.2 wt %; and methylcyclohexenes, 0.4 wt %. The conversion rate of benzene was 32.0%, while that of toluene was 1.2%, with the ratio of the benzene conversion rate/toluene conversion rate being 26.7.

Example 11

The hydrogenation reaction was carried out under the same conditions as in Example 10, except the reaction temperature was 200° C. The liquid yield was 100%, with the product distribution being benzene, 29.9 wt %; cyclohexane, 9.5 wt %; cyclohexene, 9.5 wt %; toluene, 50.1 wt %; methylcyclohexane, 0.3 wt %; and methylcyclohexenes, 0.6 wt %. The conversion rate of benzene was 38.9%, while that of toluene was 1.8%, with the ratio of the benzene conversion rate/toluene conversion rate being 21.6.

Example 12

The hydrogenation reaction was carried out under the same conditions as in Example 10, except the reaction pressure was kept at 20 kg/cm2.G. The liquid yield was 100%, with the product distribution being benzene, 32.1 wt %; cyclohexane, 11.9 wt %; cyclohexene, 4.3 wt %; toluene, 50.0 wt %; methylcyclohexane, 1.0 wt %; and methylcyclohexenes, 0.7 wt %. The conversion rate of benzene was 33.5%, while that of toluene was 3.3%, with the ratio of the benzene conversion rate/toluene conversion rate being 10.2.

Example 13

To a stainless steel autoclave with an internal volume of 300 ml, 80 ml of distilled water, 1.0 g of ruthenium oxide (manufactured by Aldlich Co.), 1.92 g of $ZnSO_4.7H_2O$ (special grade, manufactured by Kanto Chemical Co., Ltd.), and 1.92 g of NaOH (first grade, manufactured by Kanto Chemical Co., Ltd.) were charged and mixed. After the addition of 10 ml of benzene (a special grade product of Wako Pure Chemical Industries, Ltd.) and 10 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 11.0 wt %; cyclohexane, 25.5 wt %; cyclohexene, 12.1 wt %; toluene, 48.0 wt %; methylcyclohexane, 1.6 wt %; and methylcyclohexenes, 1.8 wt %. The conversion rate of benzene was 77.4%, while that of toluene was 6.6%, with the ratio of the benzene conversion rate/toluene conversion rate being 11.7.

Example 14

The hydrogenation reaction was carried out under the same conditions as in Example 13, except the amounts of the distilled water, benzene, and toluene were 20 ml, 40 ml, and 40 ml, respectively. The liquid yield was 100%, with the product distribution being benzene, 48.1 wt %; cyclohexane, 0.7 wt %; cyclohexene, 1.6 wt %; toluene, 49.5 wt %; methylcyclohexane, 0.0 wt %; and methylcyclohexenes, 0.1 wt %. The conversion rate of benzene was 4.6%, while that of toluene was 0.2%, with the ratio of the benzene conversion rate/toluene conversion rate being 23.

Example 15

To a stainless steel autoclave with an internal volume of 300 ml, 50 ml of distilled water, 1.0 g of ruthenium oxide (manufactured by Aldlich Co.), 1.92 g of ZnO (special grade, manufactured by Kanto Chemical Co., Ltd.), and 1.92 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 $kg/cm^2$.G. The temperature was raised to 150° C., while stirring the mixture at 800 rpm. The hydrogenation reaction was carried out at this temperature for 3 hours, while pressurizing the reaction system with hydrogen gas to 50 $kg/cm^2$.G, each time the pressure dropped to 40 $kg/cm^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 33.0 wt %; cyclohexane, 7.5 wt %; cyclohexene, 9.8 wt %; toluene, 49.3 wt %; methylcyclohexane, 0.1 wt %; and methylcyclohexenes, 0.3 wt %. The conversion rate of benzene was 34.4%, while that of toluene was 0.8%, with the ratio of the benzene conversion rate/toluene conversion rate being 43.0.

Example 16

The hydrogenation reaction was carried out under the same conditions as in Example 15, except 1.92 g of $Zn(NO_3)_2$ (special grade, manufactured by Wako Pure Chemical Industries, Ltd.) was used instead of ZnO. The liquid yield was 100%, with the product distribution being benzene, 38.7 wt %; cyclohexane, 5.4 wt %; cyclohexene, 6.2 wt %; toluene, 48.1 wt %; methylcyclohexane, 0.4 wt %; and methylcyclohexenes, 1.2 wt %. The conversion rate of benzene was 23.1%, while that of toluene was 3.2%, with the ratio of the benzene conversion rate/toluene conversion rate being 7.2.

Example 17

The hydrogenation reaction was carried out under the same conditions as in Example 15, except 1.92 g of $Zn_3(PO_4)_2.4H_2O$ (special grade manufactured by Wako Pure Chemical Industries, Ltd.) was used instead of ZnO. The liquid yield was 100%, with the product distribution being benzene, 37.2 wt %; cyclohexane, 5.3 wt %; cyclohexene, 7.8 wt %; toluene, 47.3 wt %; methylcyclohexane, 0.7 wt %; and methylcyclohexenes, 1.7 wt %. The conversion rate of benzene was 26.0%, while that of toluene was 4.8%, with the ratio of the benzene conversion rate/toluene conversion rate being 5.4.

Example 18

The hydrogenation reaction was carried out under the same conditions as in Example 15, except 1.92 g of zinc powder (special grade manufactured by Wako Pure Chemical Industries, Ltd.) was used instead of ZnO. The liquid yield was 100%, with the product distribution being benzene, 41.2 wt %; cyclohexane, 3.0 wt %; cyclohexene, 6.1 wt %; toluene, 48.7 wt %; methylcyclohexane, 0.2 wt %; and methylcyclohexenes, 0.8 wt %. The conversion rate of benzene was 18.1%, while that of toluene was 2.0%, with the ratio of the benzene conversion rate/toluene conversion rate being 9.1.

Example 19

To a stainless steel autoclave with an internal volume of 300 ml, 50 ml of distilled water, 1.0 g of ruthenium oxide (manufactured by Aldlich Co.), 1.92 g of $ZnO.7H_2O$ (special grade, manufactured by Kanto Chemical Co., Ltd.), and 1.92 g of KOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 $kg/cm^2$.G. The temperature was raised to 150° C., while stirring the mixture at 800 rpm. The hydrogenation reaction was carried out at this temperature for 3 hours, while pressurizing the reaction system with hydrogen gas to 50 $kg/cm^2$.G, each time the pressure dropped to 40 $kg/cm^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 32.9 wt %; cyclohexane, 7.3 wt %; cyclohexene, 10.0 wt %; toluene, 49.1 wt %; methylcyclohexane, 0.3 wt %; and methylcyclohexenes, 0.4 wt %. The conversion rate of benzene was 34.5%, while that of toluene was 1.4%, with the ratio of the benzene conversion rate/toluene conversion rate being 24.6.

Example 20

The hydrogenation reaction was carried out under the same conditions as in Example 19, except 1.92 g of anhydrous sodium carbonate (special grade manufactured by Wako Pure Chemical Industries, Ltd.) was used instead of KOH. The liquid yield was 100%, with the product distribution being benzene, 35.4 wt %; cyclohexane, 6.0 wt %; cyclohexene, 8.9 wt %; toluene, 47.3 wt %; methylcyclohexane, 0.7 wt %; and methylcyclohexenes, 1.7 wt %. The conversion rate of benzene was 29.6%, while that of toluene was 4.8%, with the ratio of the benzene conversion rate/toluene conversion rate being 6.2.

Comparative Example 1

To a stainless steel autoclave with an internal volume of 300 ml, 50 ml of distilled water, 1.0 g of ruthenium oxide (manufactured by Aldlich Co.), and 1.92 g of $ZnSO_4.7H_2O$ (special grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 $kg/cm^2$.G. The temperature was raised to 150° C., while stirring the mixture at 800 rpm. The hydrogenation reaction was carried out at this temperature for 3 hours, while pressurizing the reaction system with hydrogen gas to 50 $kg/cm^2$.G, each time the pressure dropped to 40 $kg/cm^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 0.0 wt %; cyclohexane, 50 wt %; toluene, 9.8 wt %; and methylcyclohexane, 40.2 wt %. The conversion rate of benzene was 100%, while that of toluene was 80.4%, with the ratio of the benzene conversion rate/toluene conversion rate being 1.2.

Comparative Example 2

To a stainless steel autoclave with an internal volume of 300 ml, 50 ml of distilled water, 1.0 g of ruthenium oxide (manufactured by Aldlich Co.), and 1.92 g of NaOH (first grade, manufactured by Kanto Chemical Co., Ltd.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 0.0 wt %; cyclohexane, 50.2 wt %; toluene, 2.5 wt %; and methylcyclohexane, 47.3 wt %. The conversion rate of benzene was 100%, while that of toluene was 95.0%, with the ratio of the benzene conversion rate/toluene conversion rate being 1.1.

Comparative Example 3

To a stainless steel autoclave with an internal volume of 300 ml, 50 ml of distilled water and 1.0 g of ruthenium oxide (manufactured by Aldlich Co.) were charged and mixed. After the addition of 25 ml of benzene (a special grade product of Wako Pure Chemical Industries, Ltd.) and 25 ml of toluene (a special grade product of Wako Pure Chemical Industries, Ltd.), the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was, dehydrated with the addition of 5 g of anhydrous sodium sulfate and analyzed by FID gas chromatography (with a PONA column inserted), to give a liquid yield of 100%, with the product distribution being benzene, 0.0 wt %; cyclohexane, 49.3 wt %; toluene, 0.0 wt %; and methylcyclohexane, 50.7 wt %. The conversion rate of benzene and toluene was both 100%, with the ratio of the benzene conversion rate/toluene conversion rate being 1.

Comparative Example 4

To a stainless steel autoclave with an internal volume of 300 ml, 1.0 g of ruthenium oxide (manufactured by Aldlich Co.), 50 ml of benzene (a special grade product of Wako Pure Chemical Industries, Ltd.), and 50 ml of toluene (a special grade product of Wako Pure Chemical Industries, Ltd.) were charged, and the reaction system was pressurized with hydrogen gas to 50 kg/cm$^2$.G. The temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the catalyst and analyzed by FID gas chromatography (with a PONA column inserted), to give a liquid yield of 100%, with the product distribution being benzene, 0.0 wt %; cyclohexane, 49.6 wt %; toluene, 0.0 wt %; and methylcyclohexane, 50.4 wt %. The conversion rate of benzene and toluene was both 100%, with the ratio of the benzene conversion rate/toluene conversion rate being 1.

Example 21

To a stainless steel autoclave with an internal volume of 300 ml, 50 ml of distilled water, 1.0 g of ruthenium oxide (manufactured by Aldlich Co.), 1.92 g of $ZnSO_4.7H_2O$ (special grade, manufactured by Kanto Chemical Co., Ltd.), and 1.92 g of NaOH (first grade, manufactured by Kanto Chemical Co., Ltd.) were charged and mixed. 50 ml of a mixture consisting of 10.8 wt % of benzene (a special grade product of Wako Pure Chemical Industries, Ltd.), 22.6 wt % of toluene (a special grade product of Wako Pure Chemical Industries, Ltd.), 22.2 wt % of p-xylene (a special grade product of Wako Pure Chemical Industries, Ltd.), 21.8 wt % of mesitylene (a special grade product of Wako Pure Chemical Industries, Ltd.), and 22.6 wt % of n-hexane (a special grade product of Wako Pure Chemical Industries, Ltd.), modeled on a reformate gasoline, was charged to the reactor. The reaction system was pressurized with hydrogen gas to 50 kg/cm$^2$.G and the temperature was raised to 150° C., while stirring the mixture at 800 rpm. The hydrogenation reaction was carried out at this temperature for 3 hours, while pressurizing the reaction system with hydrogen gas to 50 kg/cm$^2$.G, each time the pressure dropped to 40 kg/cm$^2$.G. After the reaction, the organic layer was separated from the aqueous layer. The organic layer was dehydrated with the addition of 5 g of anhydrous sodium sulfate and analyzed by FID gas chromatography (with a PONA column inserted), to give a liquid yield of 100%, with the product distribution being benzene, 5.9 wt %; cyclohexane, 2.5 wt %; cyclohexene, 2.4 wt %; toluene, 22.1 wt %; p-xylene, 22.4 wt %; mesitylene, 22.1 wt %; and n-hexane, 22.6 wt %. The conversion rate of benzene was 45.4%, while that of alkylbenzenes was 0.0%.

Obviously, numerous modifications and variations of the present invention are possible in light of the above teachings. It is therefore to be understood that within the scope of the appended claims, the invention may be practiced otherwise than as specifically described herein.

I claim:

1. A process for selectively hydrogenating benzene in a hydrocarbon oil containing benzene and at least one aromatic compound containing one or more alkyl groups which comprises reacting the hydrocarbon oil with hydrogen gas in the presence of an alkaline aqueous layer comprising (1) a hydrogenation catalyst consisting essentially of at least one metal in Group VIII of the Periodic Table, or compound thereof which is converted into a Group VIII metal in the reaction system, either supported on a carrier or as particles of the metal or the compound, and (2) zinc or a zinc compound, to produce hydrogenated benzene, wherein the conversion rate of benzene to hydrogenated benzene is greater than the conversion rate of said at least one aromatic compound to any hydrogenated said compound.

2. The process according to claim 1, wherein the molar ratio of the Group VIII metal in the hydrogenation catalyst and the zinc or zinc compounds is in the range of 1:100–100:1.

3. The process according to claim 1, wherein the molar ratio of the Group VIII metal in the hydrogenation catalyst and the zinc or zinc compounds is in the range of 1:10–10:1.

4. The process according to claim 1, wherein the the Group VIII metal is Ni, Ru, Rh, Pd, or Pt.

5. The process according to claim 1, wherein the the Group VIII metal is Ru.

6. The process according to claim 1, wherein the hydrogenation catalyst is at least one Group VIII metal carried on a carrier selected from the group consisting of alumina, silica, silica alumina, iron oxide, magnesia, zirconia, and carbon.

7. The process according to claim 1, wherein the hydrogenation catalyst is particles of at least one Group VIII metal not supported on a carrier.

8. The process according to claim 1, wherein the hydrogenation catalyst is particles of at least one compound which is converted into a Group VIII metal in the reaction system and not supported on a carrier.

9. The process according to claim 1, wherein the zinc or the zinc compound is selected from the group consisting of zinc powders, zinc particles, zinc acetate, zinc benzoate, zinc bromide, zinc carbonate, zinc chloride, zinc iodide, zinc lactate, zinc nitrate, zinc oxide, zinc pyrophosphate, zinc phosphate, zinc salicylate, and zinc sulfate.

10. The process according to claim 1, wherein the zinc compound is zinc oxide or zinc sulfate.

11. The process according to claim 1, wherein the alkaline aqueous layer has a pH of 9–14.

12. The process according to claim 1, wherein the concentration of an alkaline agent used for the alkaline aqueous layer is 0.01–5M.

13. The process according to claim 1, wherein the concentration of an alkaline agent used for the alkaline aqueous layer is 0.1–1M.

14. The process according to claim 1, wherein the reaction temperature is 50°–300° C.

15. The process according to claim 1, wherein the reaction temperature is 100°–200° C.

16. The process according to claim 1, wherein the molar ratio of benzene and the Group VIII metal in the hydrogenation catalyst is 100–1,000.

17. The process according to claim 12, wherein the alkaline agent is selected from lithium hydroxide, sodium hydroxide, potassium hydroxide, carbonates or bicarbonates of an alkali metal compound.

18. The process according to claim 1, wherein the hydrocarbon oil is in an organic layer, and the ratio of the organic layer and the aqueous layer is 0.1–10 (vol/vol).

19. The process according to claim 1, wherein the reaction is carried out under a hydrogen partial pressure of 5–100 $kg/cm^2$.G.

20. The process according to claim 1, wherein the ratio of the conversion rate of benzene to the conversion rate of said at least one aromatic compound is at least 5.4.

21. The process according to claim 1, wherein the aromatic compound is an alkyl benzene.

22. The process according to claim 21, wherein the alkyl benzene comprises toluene.

* * * * *